US005573419A

United States Patent [19]

Chen

[11] Patent Number: 5,573,419

[45] Date of Patent: Nov. 12, 1996

[54] SAFETY LAMPHOLDER FOR CHRISTMAS TREE LIGHT SETS AND THE LIKE

[76] Inventor: Ming-hsiung Chen, 16, Alley 3, Lane 227, Nung-an Street, Taipei, Taiwan

[21] Appl. No.: 362,844

[22] Filed: Dec. 22, 1994

[51] Int. Cl.[6] ..... H01R 4/24

[52] U.S. Cl. ..... 439/340; 439/419; 439/662; 439/667

[58] Field of Search ..... 439/340, 320, 439/339, 419, 658, 662, 663, 664, 665, 667

[56] References Cited

U.S. PATENT DOCUMENTS 1,727,148 5/1925 White ..... 439/340
5,385,485 1/1995 Fu ..... 439/419
5,439,389 8/1995 Cheng et al. ..... 439/419
5,474,467 12/1995 Chen ..... 439/419

*Primary Examiner*—P. Austin Bradley
*Assistant Examiner*—T. C. Patel
*Attorney, Agent, or Firm*—Ladas & Parry

[57] ABSTRACT

A safety lampholder has center and side contacts which are concealed and cannot easily be touched by fingers when the lamp screw base is not threaded into the screwthreads. Ring and tip contacts of the lamp screw base are disposed in contact with the center and side contacts of the lampholder when the lamp screw base is threaded into position. The inside wall of the lampholder has separated steps, which have a uniform chambered angle R meeting UL specifications and which define the screwthread for mounting the lamp screw base.

1 Claim, 5 Drawing Sheets

SAFETY LAMPHOLDER FOR CHRISTMAS TREE LIGHT SETS AND THE LIKE

BACKGROUND OF THE INVENTION

The present invention relates to lampholders, and relates more particularly to a safety lampholder of critical specifications for Christmas tree light sets and the like which is economic to manufacture.

Various decorative strings and Christmas tree light sets are well-known and widely used everywhere in the world, especially in western countries during Christmas holidays. While using these decorative strings and Christmas tree light sets, the requirement for a safe operation is critical. UL and CSA define strict specifications on these products. UL defines safety specifications on lampholders for Christmas tree light sets under UL496 and UL588. These specifications were amended in 1993 because previous definitions were found, in long uses by consumers, unable to eliminate certain shortcomings and could result in certain dangers and harm. The new specifications will become effective on Jan. 2, 1995.

If Christmas tree light set manufacturers keep using existing molds to manufacture lampholders by means of conventional lampholder production methods, the products will be unable to pass through the various safety tests according to the new specifications of the UL codes concerned because of the following two main reasons:

1. The new UL specifications define the inner diameter (D, D1), number of turns (Y), angle (R), and pitch (P) of the inner screwthread, as well as the relative positions and sizes between the inner screwthread and the center contact (C) (see FIGS. 1 and 2). Because conventional lampholders (A) are commonly injection-molded from plastics, the threaded portions of the mold must slope in one direction so that the finished lampholder can be forced out of the mold without damaging or deforming the inner screwthread (see FIG. 3). Because of this limitation, the inner diameters of the turns of the inner screwthread are not uniform, and the angle of the inner screwthread (see FIG. 3) cannot meet the standard angle R of the requirement of the new UL specifications (see FIGS. 1 and 2). Christmas tree light set manufacturers tried different measures to make lampholders subject to the new UL specifications, for example: fitting a metal screw shell with an inner screwthread into a barrel-like plastic shell. However, the method of fitting a threaded metal screw shell into a non-thread plastic shell to form a lampholder complicates the manufacturing process and greatly increases the manufacturing cost. Furthermore, the threaded metal screw shell may be turned by the lamp relative to the plastic shell, causing the threaded metal screw shell to disconnect from the plastic shell. There is known another method of making a lampholder in conformity with the new UL specifications by: preparing two internally threaded half-round plastic shells according to the new UL specifications and then fastening them into a cylindrical lampholder by a ultrasonic sealing process, hooks, or other suitable fastening methods or devices. This method is also complicated and will increase the manufacturing cost of the lampholder. Furthermore, a lampholder made according to this method is not durable in use because the two half-round plastic shells tend to disconnect from each other after long uses. When the lampholder cracks, the contacts may become exposed to the outside and touched by the user.

2. The new UL specifications define the positioning of the center and side contacts by using a variety of fastening means to securely fix them in place and to prevent them from being forced to contact each other or cause a short circuit. According to conventional lampholders (A), the center contact (C) and side contact (E) have a respective free end suspended inside the shell, and therefore they tend to be forced out of place (see FIG. 4).

SUMMARY OF THE INVENTION

It is therefore the main object of the present invention to provide a safety lampholder for a Christmas tree light set which meets the new UL specifications. It is another object of the present invention to provide a safety lampholder for a Christmas tree light set which is inexpensive and easy to manufacture. It is still another object of the present invention to provide a safety lampholder which prevents consumers from receiving an electric shock.

The above and other objects of the present invention will be described by way of example with reference to the drawings. However, the drawings are for the purposes of understanding only. Various modifications and changes could be made without departing from the spirit and scope of the invention.

Figure 7:
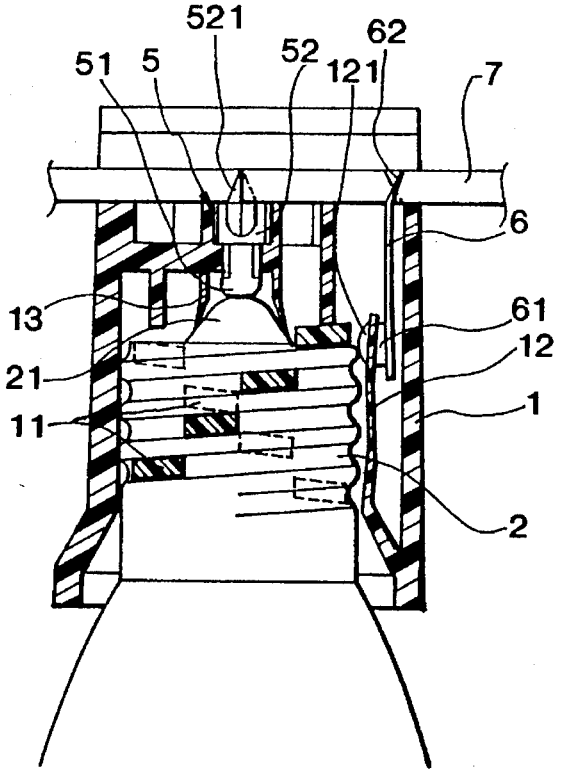
FIG. 7 is a longitudinal view in section of a lampholder according to the present invention, showing the lamp screw base threaded into the screwthread defined by the separated steps and in contact with the side and center contacts.
Figure 10:
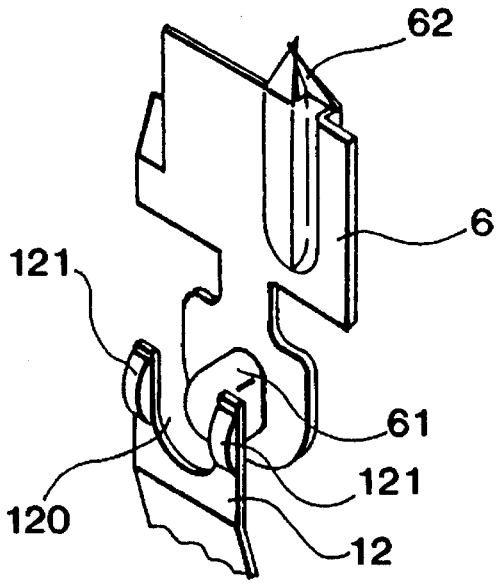
Figure 11:
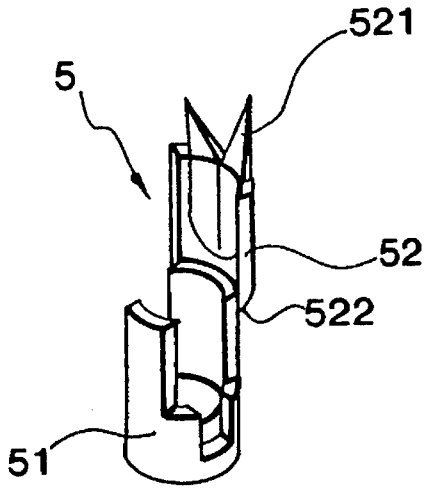
Figure 12:
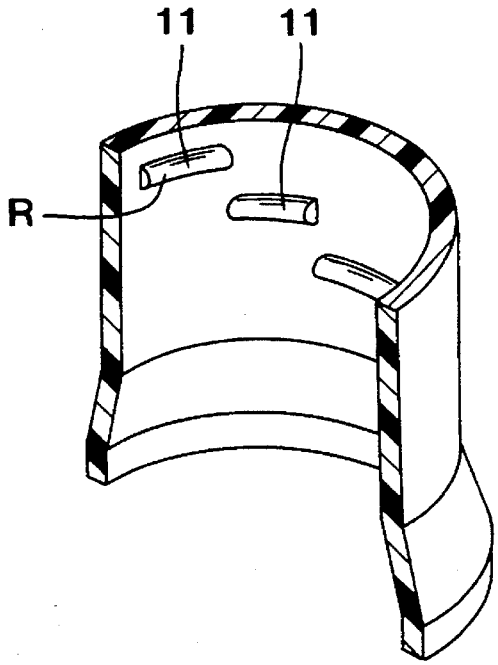

FIG. *9a* and FIG. *9b* are top and side views respectively of the lampholder of FIG. 7;

FIG. 10 is an elevational view of the insulative spring strip and the side contact for the lampholder shown in FIG. 7;

FIG. 11 is an elevational view of a center contact according to the present invention; and FIG. 12 is a perspective view, partially in section, of a portion of the lampholder.

DETAILED DESCRIPTION OF THE PREFERRED EMBODIMENT

Figure 1:
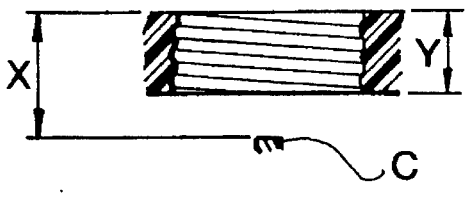
FIG. 1 PRIOR ART
FIG. 1 is a view showing the number of turns of the inner screwthread and its positioning relative to the center contact in a lampholder for a Christmas tree light set according to the new UL specifications.
Figure 2:
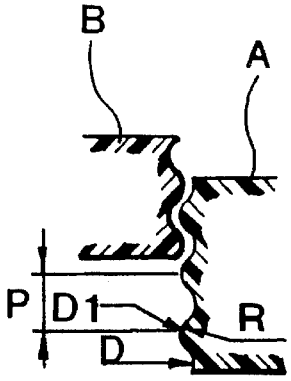
FIG. 2 PRIOR ART
FIG. 2 is a view showing the inner diameter, number of turns, angle, and pitch of the inner screwthread and their relative positions according to the new UL specifications.
Figure 3:
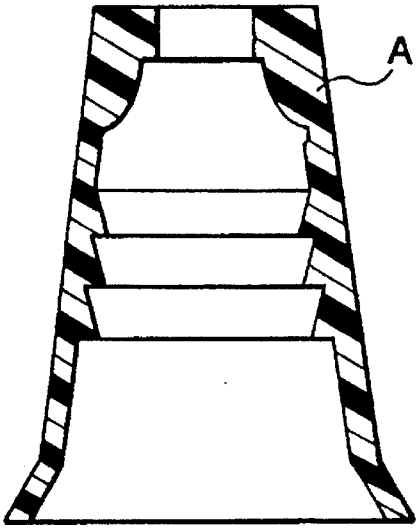
FIG. 3 PRIOR ART
FIG. 3 is a sectional view showing the oblique angle of the screwthread of a lampholder for a Christmas tree light set according to the prior art.
Figure 4:
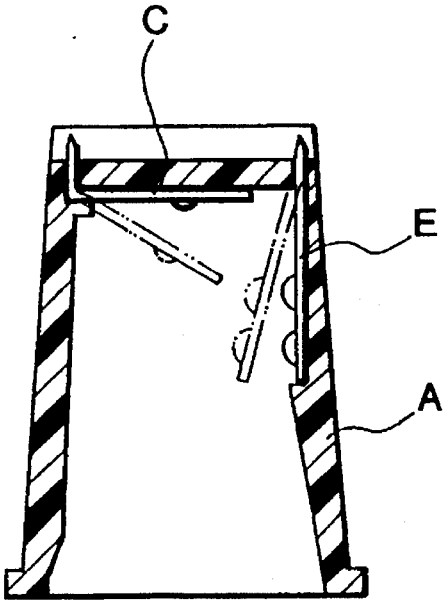
FIG. 4 PRIOR ART
FIG. 4 is a sectional view showing the displacement of the free ends of the center and side contacts in a lampholder for a Christmas tree light set according to the prior art.
Figure 5:
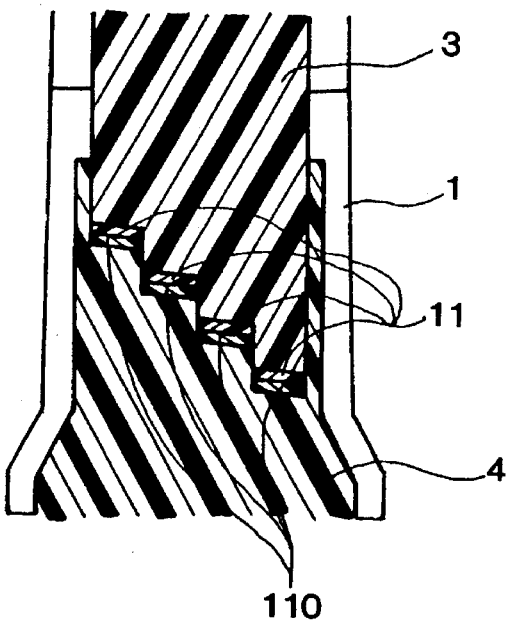
FIG. 5 is a sectional view of a mold for making separated steps on the inside wall of the lampholder according to the present invention.
Figure 6:
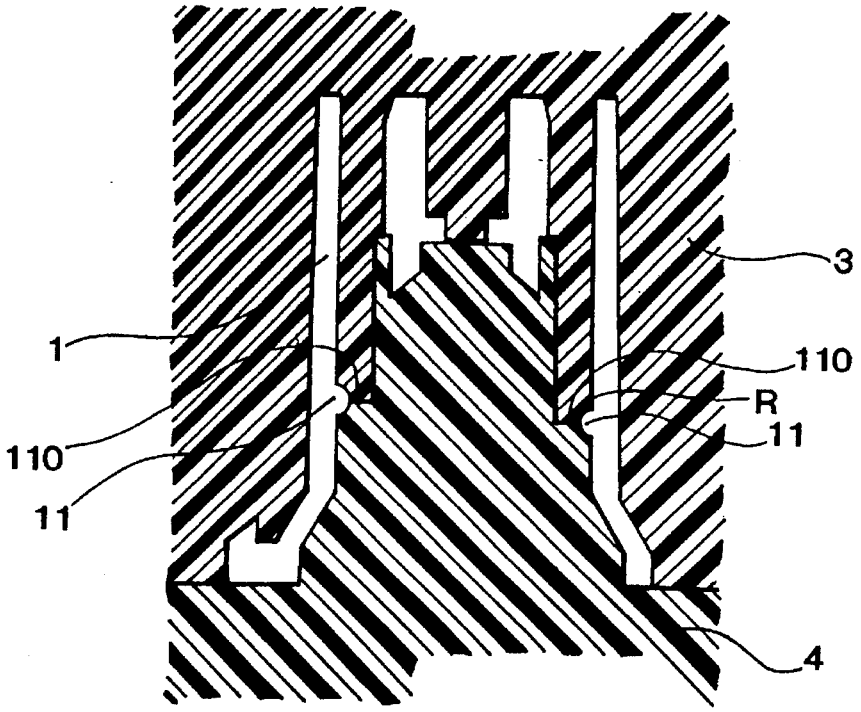
FIG. 6 is another sectional view of the mold of FIG. 5 for making R angle on the separated steps.

In order to achieve economic production, minimize the manufacturing cost, and meet the new UL inner scrwethread specifications, each turn of the screwthread on the inside wall of the lampholder 1 is equally divided into a series of separated steps 11, then a respective pair of opposite separated steps of each turn of the screwthread are selected and used as the effective inner screwthread of the lampholder 1. The center lines which pass through the midpoints of the selected pairs of opposite separated steps are defined as the parting lines 110 between the male mold 3 and the female mold 4. Standard angles R according to the new UL specifications are respectively made on the male mold 3 and the female mold 4 at the center points of the parting lines 110. Therefore, when the lampholder 1 is injection-molded from plastics, the separated steps of the inner screwthread have the required standard angles R bilaterally raised from the inside wall of the lampholder 1 (See FIG. 6).

Figure 8:
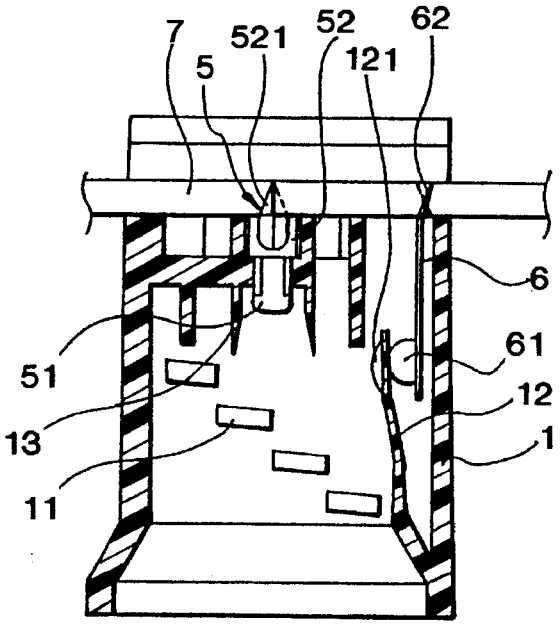
FIG. 8 is a longitudinal view in section of the lampholder of FIG. 7 showing the lamp screw base removed.
Figure 9A:
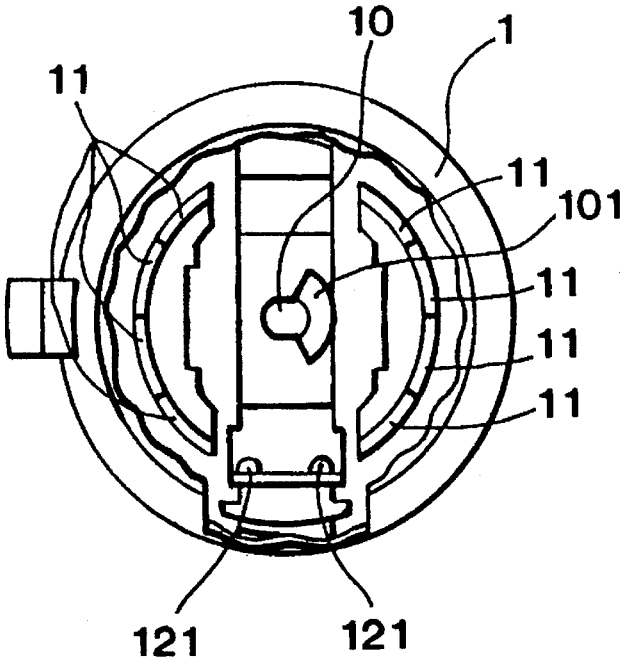
Figure 9B:
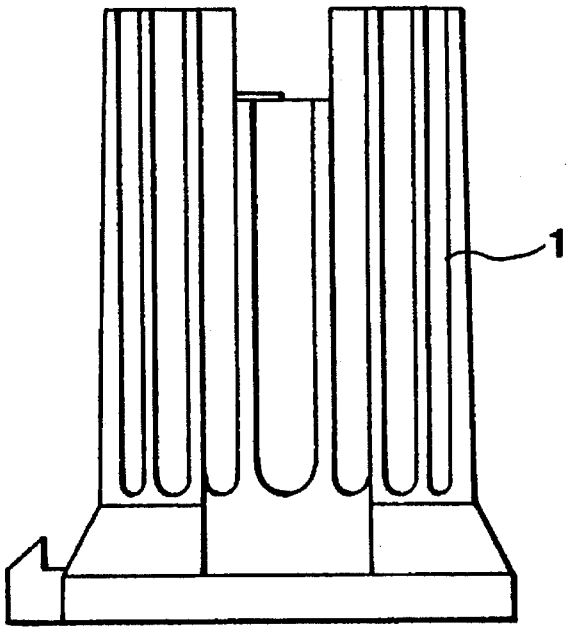

Referring to FIGS. 7, 8, and 9, the lampholder 1 has a top center hole 10, which receives the center contact 5, two opposite, and springy sloping walls 13 extended bilaterally outwards from the periphery of the bottom side of the top center hole 10. The lampholder further has an insulative spring strip 12 extending upwards from the inside wall at a location near the bottom opening and terminating in a U-notch 120 and two raised portions 121 at two opposite sides of the U-notch 120 (see FIG. 10). The side contact 6 has a projecting contact portion 61 at one side near the bottom end for connection to the U-notch 120 of the insulative spring strip 12 (see FIG. 10). The center contact 5 is a stepped structure comprised of a cylindrical bottom section 51 and a circularly curved top section 52 raised from one side of the bottom section 51, with the top section 52 having a folding flange 522 above the bottom section 51 (see FIG. 11). When the bottom section 51 of the center contact 5 is inserted into the top center hole 10, the folding bottom flange 522 is fitted to a sector groove 101 by the top center hole 10 to hold the center contact 5 in place, and the bottom end of the bottom section 51 of the center contact 5 is retained in between the two springy sloping walls 13 and protected by the springy sloping walls 13 against touch by fingers, which may inadvertently be inserted into the lampholder 1. The top section 52 of the center contact 5 terminates in a sharp edge 521 (see FIG. 11) for piercing the insulator of the electric wire 7 to make a respective electric contact (see FIGS. 7 and 8). As illustrated in FIGS. 8 and 10, the side contact 6 has a sharp edge 62 at the top for piercing the insulator of the electric wire 7 to make an electric contact. When the side contact 6 is installed inside the lampholder 1, the projecting contact portion 61 is spaced behind the U-notch 120 of the insulative spring strip 12. Before the lamp screw base 2 is threaded into the lampholder 1, the insulative spring strip 12 projects toward the longitudinal center of the lampholder 1 and is spaced from the projecting contact portion 61 of the side contact 6. If the fingers are inserted into the lampholder 1 in error, the fingers are stopped from touching the side contact 6 by the insulative spring strip 12 (see FIGS. 8 and 10). When the lamp screw base 2 is threaded into the lampholder 1, the raised portions 121 of the spring strip 12 are forced outwards toward the side contact 6, causing the projecting contact portion 61 of the side contact 6 to enter the U-notch 120 of the insulative spring strip 12 and to make an electric contact with the ring contact of the lamp screw base 2 (see FIG. 7). At the same time, the tip contact 21 at the top of the lamp screw base 2 is forced into the space between the two sloping walls 13 to make an electric contact with the center contact 5 (see FIG. 7).

What is claimed is:

1. A safety lampholder comprising an inner screwthread for the mounting of a lamp screw base of a lamp, a top center hole, a pointed center contact mounted in said top center hole, and a pointed side contact, said center contact and said side contact being respectively disposed in contact with ring and tip contacts of the lamp when the lamp screw base of the lamp is threaded into the inner screwthread, wherein:

said lampholder further comprises two opposite, springy sloping walls extending bilaterally outwards from the periphery of the bottom side of said top center hole to protect said center contact from being touched by fingers, an insulative spring strip extending upwardly from an inside wall thereof near the bottom opening and terminating in a U-notch and two raised portions at two opposite side of said U-notch, and a plurality of separated steps having a uniform chambered angle R and defining said screwthread fcr mounting the lamp screw base;

said center contact comprises a cylindrical bottom section fitted into said top center hole, and a circularly curved top section raised from one side of said bottom section, said top section having a folding flange spaced above said bottom section and fitted into a sector groove on said lampholder to hold down said bottom section in said top center hole and a sharp top edge for piercing the insulator of the electric wire; and said side contact has a projecting contact portion at one side near a bottom end thereof and spaced behind the U-notch of said insulative spring strip, and a sharp edge for piercing the insulator of the electric wire, said projecting contact portion of said side contact being disposed in said U-shaped notch to make an electric contact with the ring contact of the lamp screw base when the lamp screw base is threaded into the lampholder.

* * * * *